US008721229B2

(12) United States Patent
Heselden

(10) Patent No.: US 8,721,229 B2
(45) **Date of Patent: *May 13, 2014**

(54) GABIONS

(75) Inventor: James Heselden, Leeds (GB)

(73) Assignee: Hesco Bastion Limited, Leeds, Yorkshire (GB)

( * ) Notice: Subject to any disclaimer, the term of this patent is extended or adjusted under 35 U.S.C. 154(b) by 218 days.

This patent is subject to a terminal disclaimer.

(21) Appl. No.: 12/692,298

(22) Filed: Jan. 22, 2010

(65) Prior Publication Data

US 2010/0143049 A1 Jun. 10, 2010

Related U.S. Application Data

(63) Continuation-in-part of application No. 12/090,352, filed as application No. PCT/GB2006/050256 on Aug. 23, 2006, now Pat. No. 7,854,574.

(30) Foreign Application Priority Data

Nov. 24, 2005 (GB) ..... 0523927.2
Mar. 30, 2006 (GB) ..... 0606408.3

(51) Int. Cl.
*E02D 29/02* (2006.01)

(52) U.S. Cl.
USPC ..... 405/302.4; 405/15

(58) Field of Classification Search
USPC ..... 405/15, 16, 21, 30, 32, 284, 287, 287.1
See application file for complete search history.

(56) References Cited

U.S. PATENT DOCUMENTS

| | | | |
|---|---|---|---|
| 2,121,173 | A | 6/1938 | MacPherson |
| 3,478,999 | A | 11/1969 | Charman et al. |
| 4,483,540 | A | 11/1984 | Bordien et al. |
| 4,483,640 | A | 11/1984 | Berger et al. |
| 4,498,592 | A | 2/1985 | Colucci |
| 4,530,622 | A | 7/1985 | Mercer |
| 5,176,469 | A | 1/1993 | Alsop |
| 5,333,970 | A | 8/1994 | Heselden |
| 5,368,410 | A | 11/1994 | Ferraiolo et al. |
| 5,472,297 | A | 12/1995 | Heselden |
| 5,482,408 | A | 1/1996 | Lunardi |
| 5,636,938 | A | 6/1997 | Ragazzo |

(Continued)

FOREIGN PATENT DOCUMENTS

| | | | |
|---|---|---|---|
| CA | 2108964 | A | 4/1995 |
| DE | 20014332 | U1 | 1/2001 |

(Continued)

OTHER PUBLICATIONS

International Search Report and Written Opinion of PCT/GB2007/050760.

(Continued)

*Primary Examiner* — Benjamin Fiorello
(74) *Attorney, Agent, or Firm* — Ping Wang; Andrews Kurth LLP

(57) ABSTRACT

A single box gabion is disclosed. The gabion comprises interconnected side walls. Each side wall comprises at least one substantially closed side wall element panel that prevents a gabion fill material from falling through the side wall without the aid of a gabion lining material. The single box gabion can be coupled together to form a modular gabion structure to protect military or civilian installations from weapons assault or from elemental forces, such as flood waters, lava flows, avalanches, soil instability, slope erosion and the like.

23 Claims, 12 Drawing Sheets

(56) References Cited

U.S. PATENT DOCUMENTS

| | | | |
|---|---|---|---|
| 5,638,938 | A | 6/1997 | Lazzarotti et al. |
| 5,647,695 | A | 7/1997 | Hilfiker et al. |
| 5,788,424 | A | 8/1998 | Torch |
| 2002/0100763 | A1 | 8/2002 | Carriere |
| 2003/0035690 | A1 | 2/2003 | Earl |
| 2003/0145526 | A1 | 8/2003 | Rothfuss |
| 2006/0275084 | A1 | 12/2006 | Harbeck |

FOREIGN PATENT DOCUMENTS

| | | | |
|---|---|---|---|
| EP | 0466726 | B1 | 1/1992 |
| EP | 0735198 | A1 | 10/1996 |
| EP | 0816572 | A2 | 1/1998 |
| GB | 2293190 | A | 3/1996 |
| GB | 2423107 | A | 8/2006 |
| JP | 57-146835 | A | 9/1982 |
| JP | 2002167766 | A1 | 12/2000 |
| JP | 2004194609 | A1 | 12/2002 |
| NL | 1024629 | A1 | 10/2003 |
| WO | 9012160 | A1 | 10/1990 |
| WO | 00/40810 | A1 | 7/2000 |
| WO | 2005080691 | A | 9/2005 |
| WO | 2007/060475 | A1 | 5/2007 |
| WO | 2008/020247 | A1 | 2/2008 |

OTHER PUBLICATIONS

United Kingdom Search Report for GB Application No. 0700001.1, filed Jan. 2, 2007.

FIG.10.
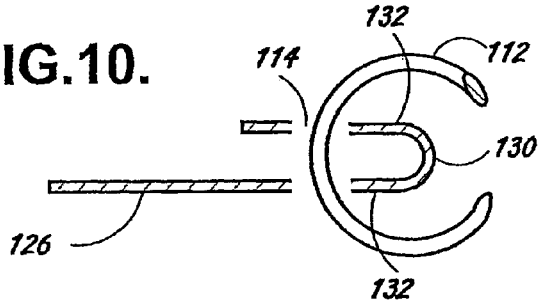
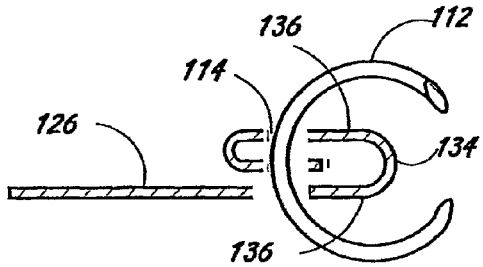
FIG.11.
FIG.12.
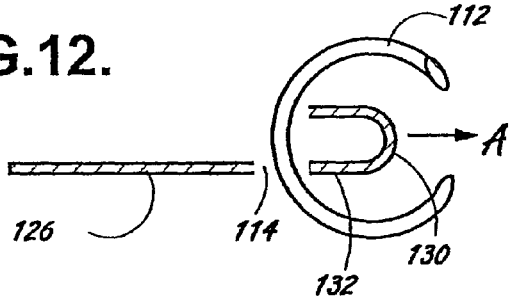
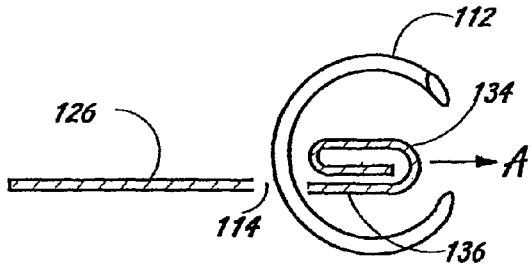
FIG.13.
FIG.14.
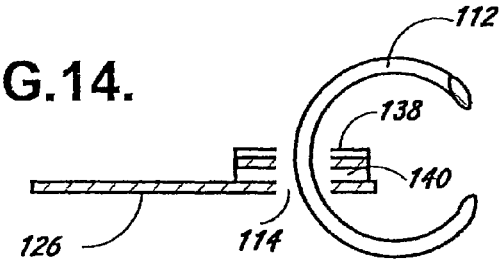
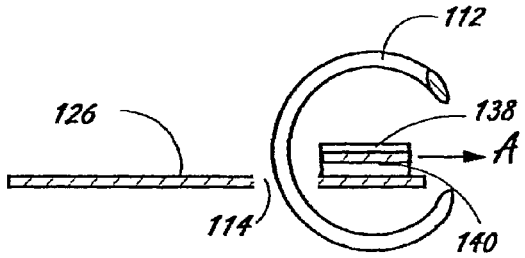
FIG.15.

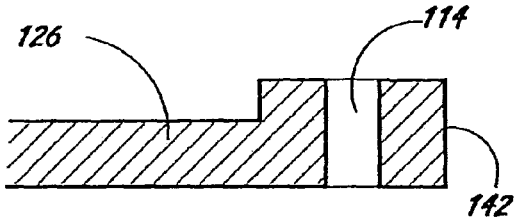
FIG.16.
FIG.17.
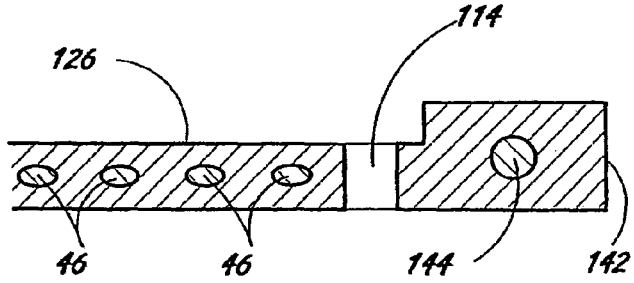
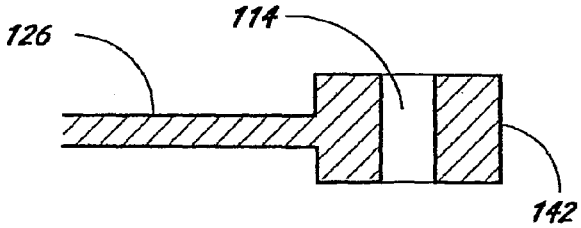
FIG.18.
FIG.19.
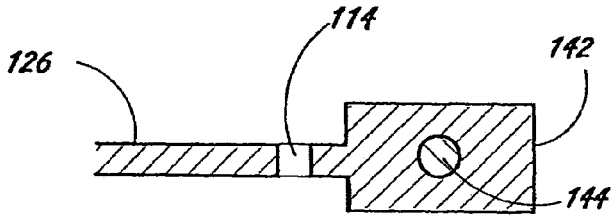

GABIONS

This application is a continuation-in part application of the U.S. patent application Ser. No. 12/090,352, which is a National Stage Entry of International Patent Application No. PCT/GB2006/050256, filed Aug. 23, 2006, which claims priority to United Kingdom Patent Application No. 0523927.2, filed Nov. 24, 2005 and United Kingdom Patent Application No. 0606408.3, filed Mar. 30, 2006. The entirety of all of the aforementioned applications is incorporated herein by reference.

FIELD

The present invention relates to gabions and especially to a single box gabion that can be used without a lining material.

BACKGROUND

Gabions are temporary or semi-permanent fortification structures which are used to protect military or civilian installations from weapons assault or from elemental forces, such as flood waters, lava flows, avalanches, slope erosion, soil instability and the like.

WO-A-90/12160 discloses wire mesh cage structures useful as gabions. The cage structure is made up of pivotally interconnected open mesh work frames which are connected together under factory conditions so that the cage can fold concertina-wise to take a flattened form for transportation to site, where it can be erected to take an open multi-compartmental form for filling with a suitable fill material, such as sand, soil, earth or rocks.

WO-A-00/40810 also concerns a multi-compartmental gabion which folds concertina-wise for transportation, and which comprises side walls extending along the length of the multi-compartmental gabion, the side walls being connected at spaced intervals along the length of the gabion by partition walls which are formed from two releasably connected sections, which after use of the gabion can be released and the gabion unzipped for recovery purposes.

Existing gabions have certain disadvantages with respect to construction and longevity. For example, such gabions frequently comprise a wire mesh cage structure lined with a geotextile material, the lining adding to the cost and complexity of the gabion structure, and constituting a significant limitation on the functionality of the gabion after deployment over a long period of time. Particularly in harsh environmental conditions (intense sunlight, wind, rain, snow, sand or salt spray, or a combination of any two or more of these), the geotextile material tends to degrade and this can weaken the functionality of the gabion by, for example, the occurrence of rips, tears or holes in the liner, through which the gabion fill material can fall.

Accordingly, there is a need for an improved gabion. There is also a need for improved multi-compartmental and single box gabions with the adaptability to form larger structures such as modular walls.

SUMMARY

One aspect of the present invention relates to a single box gabion comprising a plurality of interconnected side walls, each side wall comprising at least one substantially closed side wall element panel, wherein each substantially closed side wall element panel is manufactured of a rigid sheet material, wherein pivotal connections are provided between neighbouring side wall element panels allowing the gabion to fold for storage or transport, wherein the substantially closed side wall element panel is provided with means for receiving a hinge member for the purpose of connecting the substantially closed side wall element panel pivotally to a neighbouring side wall element panel, wherein the means for receiving a hinge member comprises one or more apertures in the panel and means for covering or blocking the one or more apertures to prevent or hinder a gabion fill material from escaping through said one or more apertures.

In one embodiment, the substantially closed side wall element panel acts in use of the gabion to prevent a gabion fill material from falling through the side wall.

In a related embodiment, the action of the substantially closed side wall element panel is effective without the aid of a gabion lining material.

In another embodiment, the rigid sheet material has a rigidity that is sufficient to prevent excessive bulging of the side wall element panel when the gabion is filled with a fill material.

In another embodiment, the hinge receiving means are provided on a region of the closed panel of greater thickness than an adjacent region of the panel.

In a related embodiment, the relatively greater thickness of the hinge receiving means section of the panel helps to prevent tearing of the panel by the hinge member in use of the gabion when the side walls of the gabion act to restrain the gabion fill material.

In a related embodiment, the region of the closed panel of relatively greater thickness is provided at or in the region of an interconnection edge of the closed panel.

In a related embodiment, the region of relatively greater thickness is an elongate panel region alongside or at the interconnection edge.

In a related embodiment, the elongate panel section of relatively greater thickness is provided by a folded over edge section of the substantially closed panel.

In a related embodiment, the corners of the panel at either or both ends of the edge being folded are removable so that they can be removed prior to folding in order to facilitate the folding over of the panel under factory conditions.

In another embodiment, the single box gabion further comprises a top panel that functions as a lid of the single box gabion.

In a related embodiment, the top panel is a substantially closed panel.

In another embodiment, the means for covering the one or more apertures to prevent or hinder a gabion fill material from escaping through said one or more apertures is selected from cover strips, cover sheets, cover tapes, cover bands, cover ribbons, cover plates, cover coatings, cover layers, cover tabs, covering adhesives and covering gels, doughs, and putties.

In another embodiment, the means for blocking the one or more apertures to prevent or hinder a gabion fill material from escaping through said one or more apertures is selected from blocking strips, blocking sheets, blocking tapes, blocking bands, blocking ribbons, blocking plates, blocking coatings, blocking layers, blocking tabs, blocking adhesives and blocking gels, doughs, and putties.

In another embodiment, the single box gabion further comprises coupling means to couple to another single box gabion.

In another embodiment, the pivotal connection between neighbouring side wall element panels is achieved by providing a coil member helically threaded through a plurality of apertures along the interconnecting edges of the neighbouring side wall element panels In another embodiment, each substantially closed panel of the single box gabion has releasable interconnections which when released allow the side wall element panels to open with respect to the gabion to allow access from the side of the gabion to any contents of the gabion compartments.

Another aspect of the present invention relates to a modular gabion structure, comprising a plurality of the single box gabions described above.

Another aspect of the present invention relates to a method for deploying the foldable single box gabion described above, comprising transporting a folded gabion to a deployment site, unfolding the gabion and filling the gabion with a fill material.

In a related embodiment, the fill material is selected from sand, earth, soil, stones, rocks, rubble, concrete, debris, snow, ice and combinations of two or more thereof.

In a related embodiment, the method further comprises coupling the unfolded single box gabion to another unfolded single box gabion.

BRIEF DESCRIPTION OF THE FIGURES

The accompanying drawings illustrate one or more embodiments of the invention and, together with the written description, serve to explain the principles of the invention. Wherever possible, the same reference numbers are used throughout the drawings to refer to the same or like elements of an embodiment.

The invention will now be more particularly described with reference to the following drawings, in which:

FIGS. 10 to 15 show different partial cross-sections through edges of the walls;

FIGS. 16 to 19 show different partial cross-sections through edges of the walls.

DETAILED DESCRIPTION

Figure 1A:
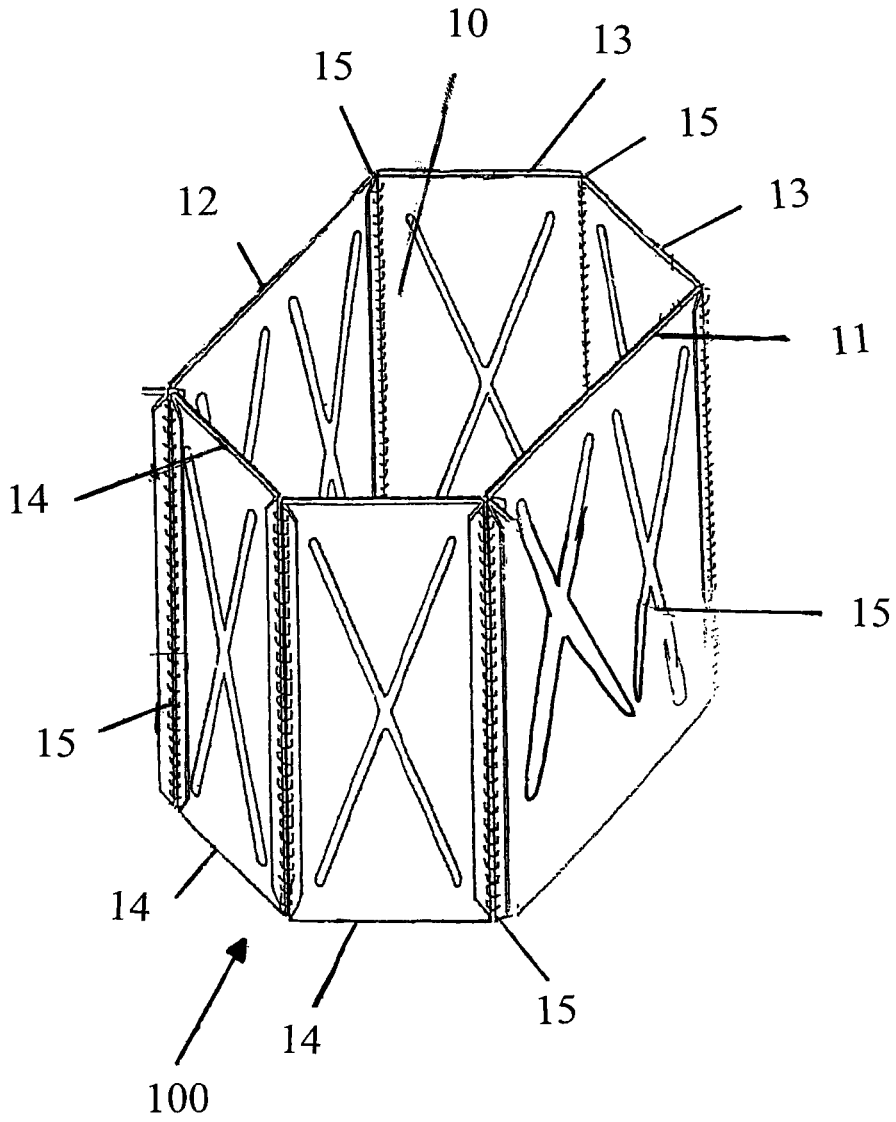
FIG. 1A shows a perspective view of a single box gabion with six side wall panels in accordance with the invention.

According to the present invention there is provided a single box gabion comprising side walls connected together to form an enclosed compartment, the side walls comprising at least one substantially closed side wall element panel, wherein the or each substantially closed side wall element is manufactured of a relatively rigid sheet material.

In certain embodiments, the single box gabion further comprise a top panel that serves as a lid of the gabion. In other embodiments, the top panel are substantially closed panels.

In certain embodiments, the single box gabion has a hexagonal compartment with six side walls. The hexagonal compartment optionally contains two larger elongated side walls on opposite sides, which folds inwardly in a manner so that the width of the flattened gabion is substantially the same as the width of the larger elongated side walls. Alternatively, the single box gabion can fold outwardly so that the width of the flattened gabion is larger than the width of elongated side wall, but the flattened gabion will be more compact in its length with this means of folding. The former manner is generally preferable as the resulting folded gabion will have a relatively smaller cross-sectional surface area in a plane orthogonal to the central longitudinal axis of the gabion.

In other embodiments, the single box gabion has a square or rectangle compartment with four side walls.

The substantially closed panel acts in use of the gabion to prevent a gabion fill material (sand, earth, soil, stones or fines, for example) from falling through the side wall without the aid of a gabion lining material.

Preferably, the rigidity of the material is sufficient to prevent excessive bulging of the side wall element panel when the gabion is filled with a fill material.

Other desirable characteristics of the sheet material include, either alone or in combination:

Durability
Toughness
Tear resistance
Scratch and erosion resistance
Corrosion resistance
Thermal stability
Ultraviolet stability
Low density
Low cost
Recyclability Suitable materials include steel, aluminium, titanium, other metals, alloys, plastics or certain natural materials, or combinations of two or more thereof. Where a metal is used, it is preferably either treated for corrosion resistance, e.g. by galvanisation and/or painting or is inherently corrosion resistant, e.g. a stainless steel.

Where the sheet material is a plastics material it may be polyethylene (PE), polypropylene (PP) or a composite such as glass fibre reinforced polymer (GFRP). The molecular weight of the chosen plastic can be selected to suit the application (e.g. LDPE, HDPE, LDPP, HDPP). Where plastics are used, they are preferably ultraviolet stabilised e.g. by the addition of fillers to prevent them becoming discoloured and/or brittle upon extended exposure to sunlight.

In certain circumstances, it may be desirable to add coloured fillers to the plastics material to provide a desired aesthetic effect. In one aspect of the invention, more than one colour filler is added to the plastics material and partially blended therewith to create a non-homogeneous coloured/marbled effect. For example; green and brown; white and grey; or yellow and brown colour fillers could be added to provide camouflage for vegetated, snowy or dessert environments, respectively. Because such colours are integral with the sheet material (i.e. not a surface decoration), they are less susceptible to removal by erosion (e.g. by sand in a sandstorm).

It is desirable to make the sheet material as thin as possible to reduce the folded volume of the gabion when being stored or transported. A major advantage of using thin-sheet materials is weight saving, which reduces transportation costs and facilitates manual deployment/rearrangement of the gabion.

The substantially closed panel is preferably provided with means for receiving a hinge member for the purpose of connecting the substantially closed panel pivotally to a neighbouring side wall element panel. The hinge receiving means are preferably provided on a region of the closed panel of greater thickness than an adjacent region of the panel. This helps to prevent tearing of the panel by the hinge member in use of the gabion when the side walls of the gabion act to restrain the gabion fill material. The region of the closed panel of relatively greater thickness is preferably provided at or in the region of an interconnection edge of the closed panel. Preferably, the region of relatively greater thickness is an elongate panel region alongside or at the interconnection edge.

In one preferred embodiment of the invention, the pivotal interconnection between connected walls and/or wall sections and/or wall elements is achieved by providing interconnected walls, wall sections and/or wall elements with a row of apertures along or in the region of an interconnection edge thereof and by providing a coil member helically threaded through a plurality of apertures along the interconnection edge. In the case of a straightforward (i.e. non-openable) pivotal connection, a single coil member may be helically threaded through the connection edge apertures of two (or more) neighbouring walls, wall sections and/or wall elements to achieve pivotal interconnection therebetween. Thus, there is provided in accordance with the invention a single box gabion as described wherein the or at least one hinge member comprises a helical coil.

Figure 7:
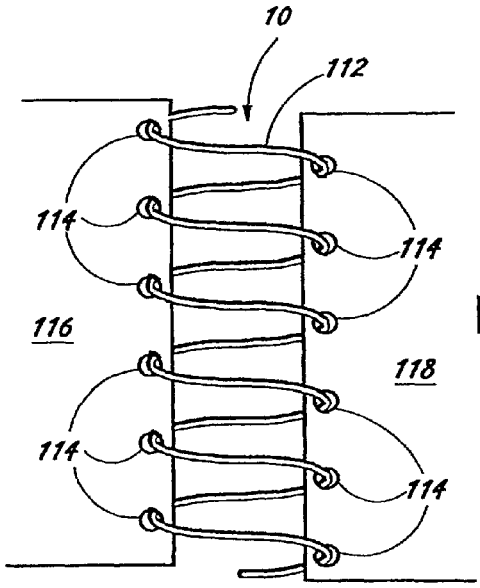
FIG. 7 shows a close-up of a hinged connection of a single box gabion according to the invention.
Figure 8:
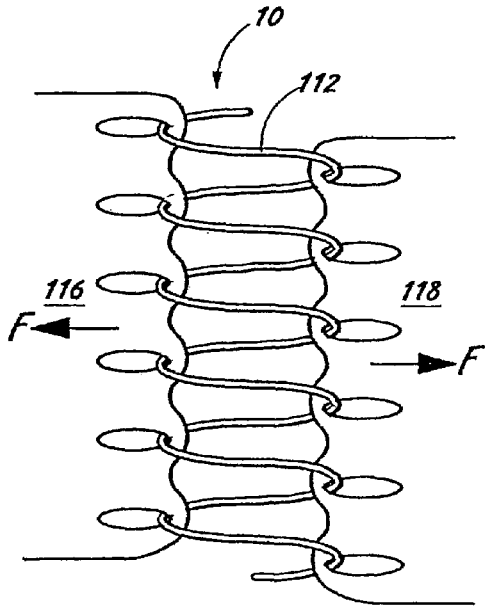
FIG. 8 shows a close-up of a hinged connection of a single box gabion according to the invention under load.
Figure 9:
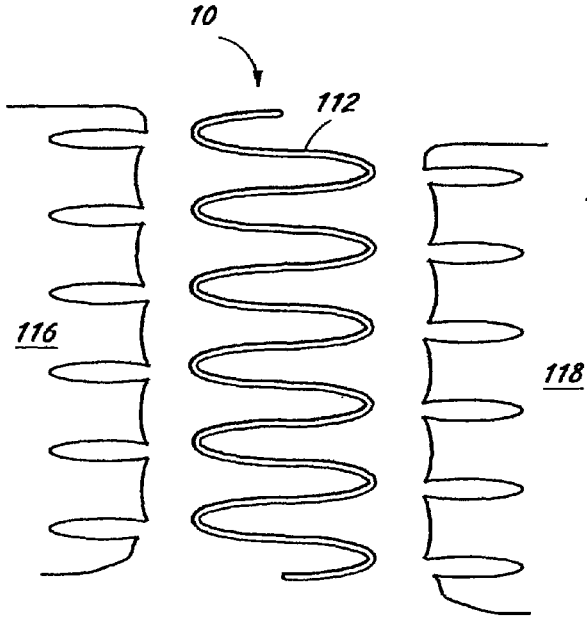
FIG. 9 shows a close-up of a hinged connection of a gabion according to the invention being broken.

In one example, illustrated by FIG. 7, the hinged connections 10 comprise helical springs 112 threaded through apertures 114 disposed towards the edges off each wall 116, 118, which are manufactured of sheet material. In FIG. 8, it can be seen that when a force F is applied to the hinged connection 110, the apertures 114 tend to deform. Upon application to sufficient force, as illustrated in FIG. 9, the apertures 114 tear-through, thereby disconnecting the hinged connection. One solution is to provide thicker sheet material. Where mesh-type walls are used, this is not necessarily a problem because the wires of the mesh can be thicker for a given overall gabion weight. However, to use sheet metal of the same thickness as the wire diameter could give rise to a prohibitively heavy gabion.

It is therefore desirable, additionally or alternatively to the aforementioned variants, to reinforce the sheet material walls in regions of increased stress.

The elongate panel section of relatively greater thickness may be provided by a folded over edge section of the substantially closed panel. In order to facilitate the folding over of the panel under factory conditions, the corners of the panel at either or both ends of the edge being folded may be removed prior to folding.

If further reinforcement is required, the edge of the sheet material can be folded a number of times or rolled-up.

Additionally or alternatively, additional reinforcing members may be affixed at or near to the edges of the sheet material. Preferably, such reinforcing members are strips that can be welded, glued or otherwise fastened in-situ.

Apertures in the sheet material may pass through one or more layers.

Where the sheet material is provided with reinforcement, the reinforcement may be faired to minimize/prevent snagging with other objects and/or a user's hands.

Fairings may be provided by way of trimming corners, removing burrs and/or providing rounded edges.

Suitably, the substantially closed panel is provided with means for connecting the panel pivotally to a neighbouring panel in the gabion. When such means comprise one or more apertures in the panel, for receiving a hinge member for example, the gabion may be provided with means for covering the one or more apertures to prevent or hinder a gabion fill material from escaping through said one or more apertures. Suitable covering means include cover strips, cover sheets, cover tapes, cover bands, cover ribbons, cover plates, cover coatings, cover layers, cover tabs, covering adhesives and covering gels, doughs, putties and the like. Alternatively, or as well, the one or more apertures may be provided with blocking means for at least partly blocking the egress of fines and other gabion fill materials from the gabion in use thereof. Suitable blocking means include blocking strips, blocking sheets, blocking tapes, blocking bands, blocking ribbons, blocking plates, blocking coatings, blocking layers, blocking tabs, blocking adhesives and blocking gels, doughs, putties and the like.

Other forms of pivotal connection between neighbouring side wall element panels are also contemplated within the scope of the invention—for example an interconnecting edge of a first neighbouring panel may be provided with a protruding portion interconnecting with a corresponding inset portion in the corresponding interconnection edge of a second neighbouring panel. A locking member may extend through the protruding portion and be received in the second neighbouring panel interconnection edge either side of the inset portion to lock the protruding portion into the inset portion in a pivotal fashion.

Alternatively, a locking member may be provided in the interconnection edge of a first neighbouring side wall element panel, extending slightly beyond the interconnection edge at the top and bottom of the panel, and one or more linking members may then secure the locking member to the second neighbouring side wall element panel in the region extending slightly beyond the interconnection edge. Many other forms of pivotal connection may also be suitable in the realisation of the invention.

The single box gabion of the invention may be provided with a plurality of side wall element panels, each comprising a substantially closed panel having releasable interconnections which when released allow the side wall element panels to open with respect to the gabion to allow access from the side of the gabion to any contents of the gabion compartments.

The single box gabion of the invention therefore facilitates post-deployment recovery of the gabion by providing at least one openable side wall section along the peripheral of the gabion. Preferably, a plurality of openable side wall sections are provided. Most preferably, all of the side wall sections of the single box gabion are openable. By "openable" is meant that the pivotal connection between the connected side wall element panels of the side wall section is provided by a hinge member provided on one or both of the connected side wall element panels and by a releasable locking member cooperating with the hinge member releasably to secure the pivotal connection therebetween. In some preferred embodiments of the invention, a first hinge member is provided on a first neighbouring side wall element panel and a second hinge member is provided on a second neighbouring side wall element panel, the releasable locking member cooperating with both the first hinge member and the second hinge member releasably to secure the pivotal connection. Opening of an openable side wall section is achievable by releasing the locking member and pulling apart the resulting unconnected side wall element panels.

Each side wall section may comprise a single side wall element panel, in which case the openable pivotal connection between neighbouring side wall element panels is located between neighbouring side wall sections. In this case the pivotal connection between neighbouring side wall element panels and the partition wall marking the boundary between corresponding neighbouring side wall sections is also openable to allow the first neighbouring side wall element panel to be released from the second neighbouring side wall element panel. Alternatively, each side wall section may comprise a plurality of side wall element panels, in which case the openable pivotal connection may be provided between neighbouring side wall element panels of a given side wall section. However, even when side wall sections comprise a plurality of side wall element panels, openable pivotal connections may be provided between neighbouring side wall sections as well as or instead of between neighbouring side wall element panels of a given side wall section.

In certain embodiments, the single box gabion further contains coupling means on one or more side wall element panels so that two single box gabions can coupled together. In one embodiment, a single box gabion is coupled to another single box gabion by aligning two side wall sections next to each other and providing a coupling means such as a nut and bolt to tie two or more single box gabions together.

The single box gabion of the invention may comprise pivotally interconnected, substantially closed, side wall element panels which are connected together under factory conditions so that the gabion can take a flattened form for transportation to site where it can be erected to take a form in which panels thereof define side walls and an open top through which the compartments of each single box gabion may be filled. Preferably, under factory conditions said panels define side walls and are pivotally interconnected edge to edge and are relatively foldable to lie face to face in the flattened form for transportation to site and can be relatively unfolded to bring the gabion to the erected condition without the requirement for any further connection of the side walls on site.

In preferred embodiments of the invention, the side walls of the single box gabion each comprise a plurality of side panels pivotally connected edge to edge and folded one relative to another. The side walls are pivotally connected thereto, the single box gabion structure being adapted to be erected on site by pulling it apart so that when it is moved from the flattened form to the erected condition the side walls unfold and having a cavity to be filled with a fill material.

Deployment of the single box gabion of the invention is generally effected by transporting the folded gabion to a deployment site, unfolding the gabion and filling each single box compartment of the gabion with a fill material. Generally the fill material will be dictated at least partly by the availability of suitable materials at the deployment site. Suitable fill materials include, but are not limited to, sand, earth, soil, stones, rocks, rubble, concrete, debris, snow, ice and combinations of two or more thereof.

According to the present invention there is also provided a modular gabion structure comprising a plurality of the single box gabions described above. In one embodiment, one or more single box gabions in the modular gabion structure are coupled or interconnected to another single box gabion. In another embodiments, all the single box gabions in the modular structure are interconnected to each other. The modular structure comprised of interconnected single box gabions can each vary in width and/or height to accommodate different configurations and purposes. The adaptability of interconnecting single box gabions has an advantage of protecting structures with corners or irregular shaped and rough terrains, which cannot be achieved by conventional gabions.

Deployment of the modular gabion structure is generally effected by transporting folded single box gabions to a deployment site, unfolding the single box gabions and coupling the unfolded single box gabions to each other, then filling each single box gabions with a fill material. Generally the fill material will be dictated at least partly by the availability of suitable materials at the deployment site. Suitable fill materials include, but are not limited to, sand, earth, soil, stones, rocks, rubble, concrete, debris, snow, ice and combinations of two or more thereof. There are a number of reasons why it could be desirable to open side wall sections of the modular gabion structure. For example, when the deployed modular structured formed from the single box gabions is to be decommissioned, it is often desirable to recover the gabion for environmental or aesthetic reasons, or simply out of consideration for the local population. Recovery of the gabion of the invention is facilitated by opening up all of the openable side wall sections of the gabion, at least partly removing the fill material from the compartments, and removing the gabion from site.

By way of further example, if the deployed modular gabion structure is damaged in use it may be desirable to replace or repair the damaged section of the gabion. Access via the openable side walls of the damaged section facilitates this. Similarly, when it is desired for reasons unconnected with damage to move, alter or replace a gabion section (for example if the position or orientation of the gabion requires alteration), such replacement is again facilitated by the capacity to remove at will fill material from selected single box gabion sections.

Therefore, it is desirable to provide one or more single box gabions in the modular gabion structure with openable side wall sections. Accordingly there is provided in accordance with the invention a single box gabion as described wherein the pivotal connection between the connected side wall element panels of each of the side wall sections, or between each neighbouring side wall section, optionally with the exception of the end side wall sections, is provided by a hinge member provided between the first side wall element panel of a given side wall section and a second neighbouring side wall element panel of the given or a neighbouring side wall section, and a releasable locking member cooperating with the hinge member releasably to secure the pivotal connection. Preferably, a first hinge member is provided on the first side wall element panel and a second hinge member is provided on the second neighbouring side wall element panel, and the releasable locking member cooperates with both first and second hinge members releasably to secure the pivotal connection.

It is also contemplated that openable side wall sections may be provided on two opposed side wall sections of a single box gabion compartment to allow access to the fill material from both sides. Accordingly the invention provides a modular structure gabion as described wherein the pivotal connection between side wall element panels of at least two single box gabions is provided by a hinge member provided between a first side wall element panel of a given side wall section of a first single box gabion and a second side wall element panel of a given side wall section of a second single box gabion, and by a releasable locking member cooperating with the releasable hinge member releasably to secure the pivotal connection.

Also contemplated is that openable side wall sections may be provided alternately on first and second opposed side walls along at least part of the length of the modular gabion structure. In this way when a modular gabion is being recovered, cooperating excavating equipment or personnel can be deployed on opposite sides of the gabion to remove fill material from neighbouring compartments simultaneously or in rapid succession if simultaneous excavation is undesirable for safety or other reasons. Thus, the invention provides a modular gabion as described wherein the connection between the connected side wall element panels of at least a plurality of side wall sections staggered on alternating opposite side walls along at least part of the length of the modular gabion is provided by a hinge member provided between a first side wall element panel of a given side wall section and a second neighbouring side wall element panel of the given, and by a releasable locking member cooperating with the hinge member releasably to secure the pivotal connection. Also contemplated within the scope of the invention is a modular gabion as described wherein the pivotal connection between the connected side wall element panels of at least a plurality of side wall sections staggered on alternating opposite side walls along at least part of the length of the modular gabion is provided by a first hinge member provided on a first side wall element panel of a given side wall section and by a second hinge member on a second side wall element panel of the given side wall section and by a releasable locking member connecting the first hinge member to the second hinge member.

In one preferred embodiment of the invention the openable pivotal interconnection of a modular structure comprising multiple single box gabions between connected side wall element panels is achieved by providing the interconnected side wall element panels with a row of apertures along or in the region of an interconnection edge thereof and by providing a first coil member helically threaded through a plurality of apertures along the interconnection edge of a first side wall element panel, a second coil member helically threaded through a plurality of apertures along the interconnection edge of a second side wall element panel (connected to the first side wall element panel along the interconnection edge) and a releasable locking member threaded through overlapped first and second coil members. Thus, in the case of an openable pivotal connection, a pair of coil members may be helically threaded through the respective opposed connection edge apertures of two neighbouring side wall element panels, and a releasable locking member inserted through the overlapped coils of the opposed pair of coil members. Accordingly, there is provided in accordance with the invention a modular gabion as described wherein at least one openable pivotal connection between neighbouring side wall element panels is provided by the presence of a pair of coil members helically threaded through respective connection edge apertures of neighbouring side wall element panels and by a releasable locking member threaded through the respective coil members when overlapped.

Thus, there is provided in accordance with the invention a modular gabion as described wherein the or at least one hinge member comprises a helical coil.

The releasable locking member may be of any suitable shape or size and may for example comprise an elongate locking pin. The pin may be provided with a gripping protrusion at one end to facilitate manual insertion and/or removal of the locking pin. The gripping protrusion may for example comprise a loop at one end of the locking pin. Accordingly there is provided in accordance with the invention a modular gabion as described wherein at least one locking member comprises an elongate locking pin.

The side walls, side wall sections, side wall element panels preferably comprise one or more panel sections of any suitable material, for example steel, aluminium, titanium, any other suitable metal or alloy, or from a plastics, ceramic or natural material such as timber, sisal, jute, coir or seagrass. Normally, steel is preferred, in which case the steel is preferably treated to prevent or hinder steel erosion during deployment of the gabion. The panel is a substantially closed panel which acts in use of the gabion to contain a gabion fill material without the need for a gabion compartment lining material, such as a geotextile liner. However, the gabion of the invention may be used together with a suitable lining material if necessary. In the case of a closed panel, connection edge apertures where needed will normally be machined or otherwise provided in or in the region of the panel edge.

Figure 1C:
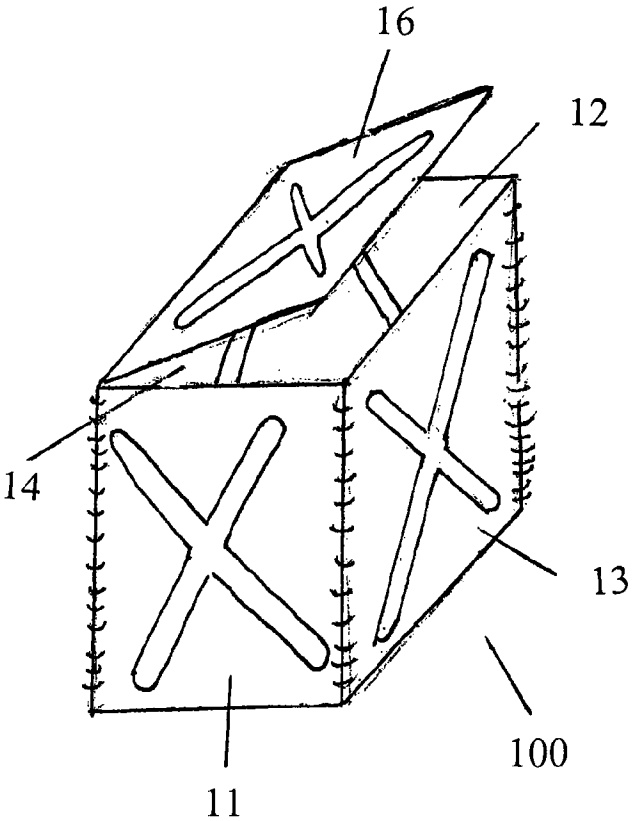
FIG. 1C shows a single box gabion with a top panel in accordance with the invention.
Figure 1B:
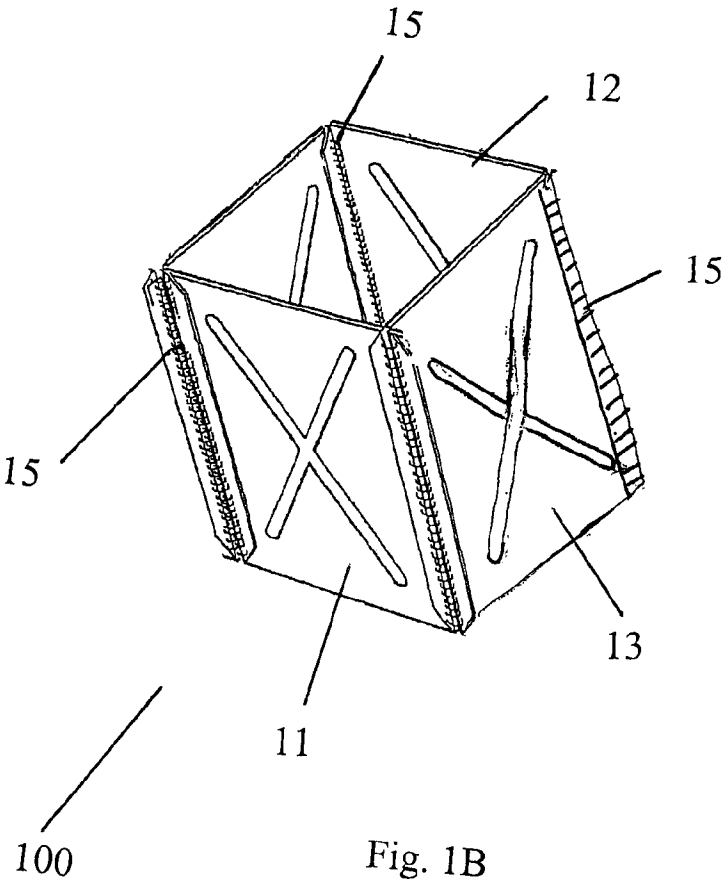
FIG. 1B shows a perspective view of a single box gabion with four side wall panels in accordance with the invention.

Referring in more detail to FIG. 1A, there is shown a single box gabion 100 comprising side wall element panels 11, 12, 13, 13', 14 and 14' connected together to form an enclosed compartment 10. The neighbouring side wall element panels are interconnected through pivotal connections 15. FIG. 1B shows another single box gabion 100 with four side walls. As shown in FIG. 1C, the single box gabion 100 may further contain a top panel 16 that serves as lid for the gabion.

The side wall panels may be provided with texture, ribbing or other irregularities in order to maintain effective strength of the panel whilst minimising its weight, and/or to provide decorative effect.

Figure 2:
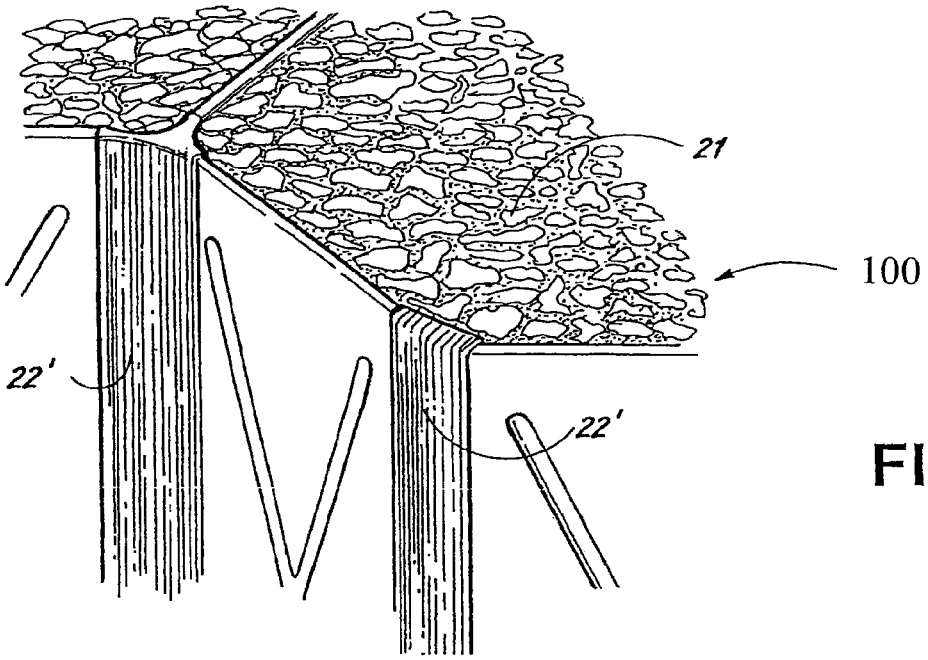
FIG. 2 shows a single box gabion filled with a gabion fill material.

Referring to FIG. 2, a single box gabion 100 is shown filled with a gabion fill material 21. Fill material 21 may be selected from any suitable available material, as hereinbefore described. Rough earth and stones are shown as the fill material in FIG. 2. FIG. 2 also shows a cover strip 22, 22' over the hinged interconnection edges of the gabion.

Figure 3A:
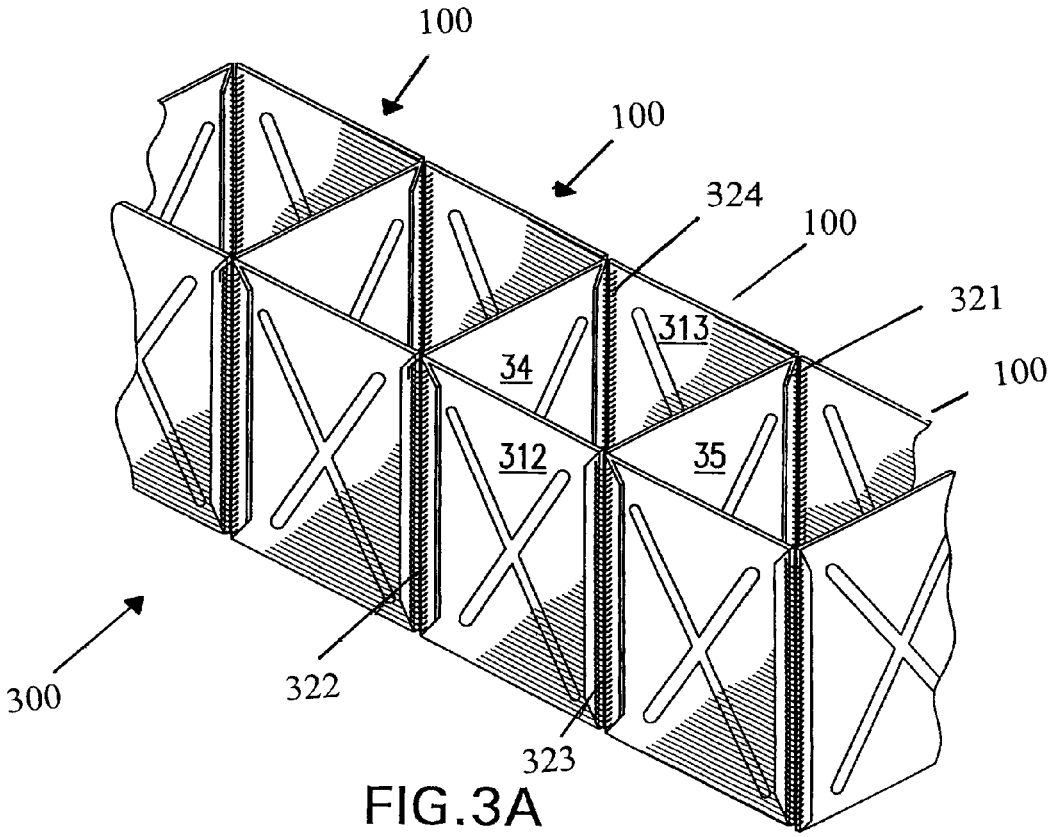
FIG. 3A shows a perspective view of a modular gabion structure formed with a plurality of single box gabions interconnected through pivotal connections in accordance with the invention.
Figure 3B:
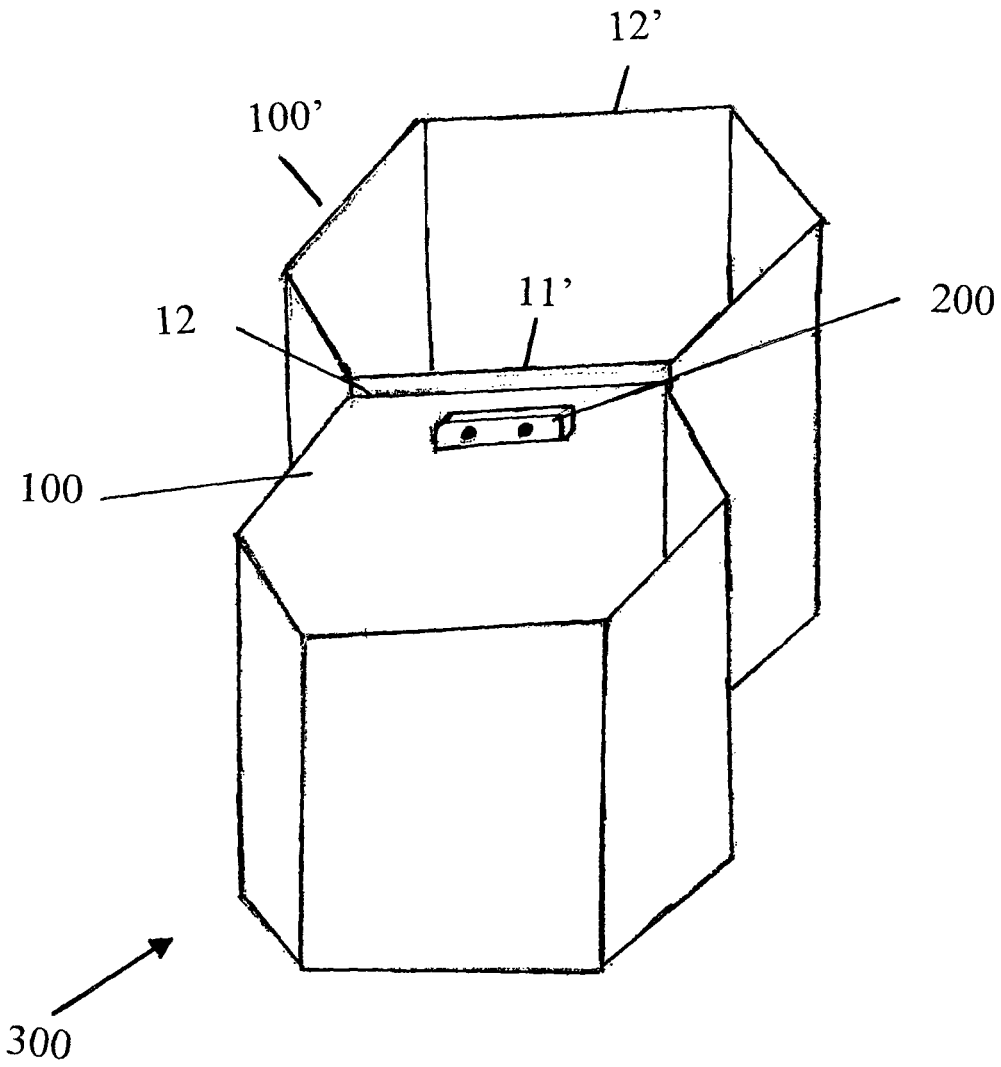
FIG. 3B show the two single box gabions interconnected with coupling means.
Figure 3C:
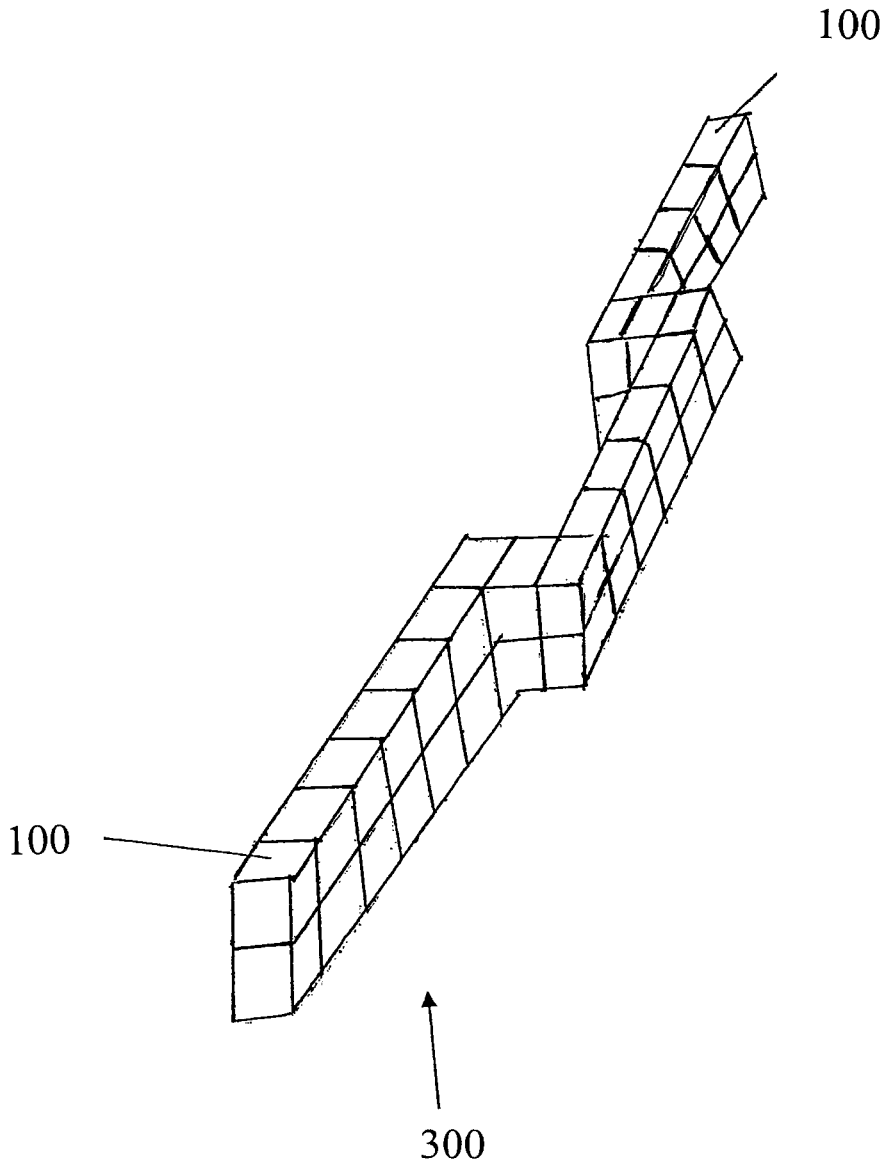
FIG. 3C shows another modular gabion structure.

Referring now to FIG. 3A, there is shown a modular gabion structure 300 formed with a plurality of single box gabion 100, each comprises side wall element panels 34, 35, 312 and 313. The single box gabions are interconnected to each other by pivotal connections 321, 322, 323 and 324. FIG. 3B shows another embodiment of modular gabion structure 300 in which the single box gabions 100 and 100' contain coupling means 200 that connects the side wall element panel 12 of the single box gabion 100 to the side wall element panel 11' of the neighbouring single box gabion 100'. FIG. 3C shows another modular gabion structure 300 formed with a plurality of single box gabions 100. In this embodiment, the single box gabions 100 may or may not be coupled to each other by pivotal connection or the coupling means.

Figure 4:
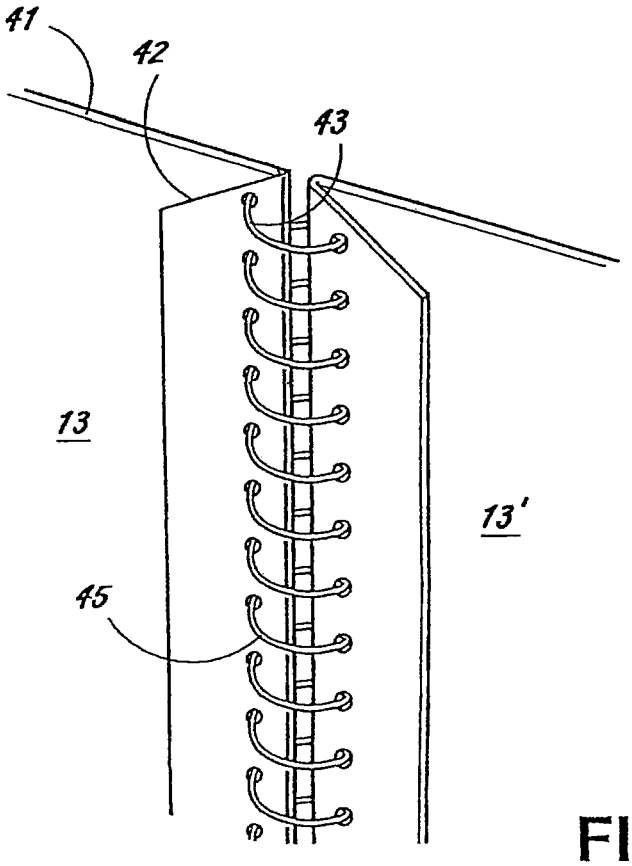
FIG. 4 shows in close-up perspective view the pivotal connection between neighbouring side wall element panels of the single box gabion.

Referring now to FIG. 4, there is shown a close-up perspective view of the pivotal connection between neighbouring side wall element panels 13 and 13' This pivotal connection may be between two side wall element panels only. Referring to FIG. 4, side wall element 13 comprises a substantially closed panel 41 comprising a folded over edge region 42 in which is machined a row of interconnection edge apertures 43. Prior to folding of folded over edge portion 42, the corners of side wall element panel 41 at either end of the interconnection edge are removed to facilitate folding. Pivotal connection therebetween is effected by a helical coil 45 which is helically threaded through the interconnection edge apertures of the neighbouring panels. Although not shown in FIG. 4, loose end 45 of helical coil 44 may be bent round or otherwise prevented from accidentally disengaging with the top most aperture of side wall element 13, and weakening the pivotal connection by such disengagement.

Figure 5:
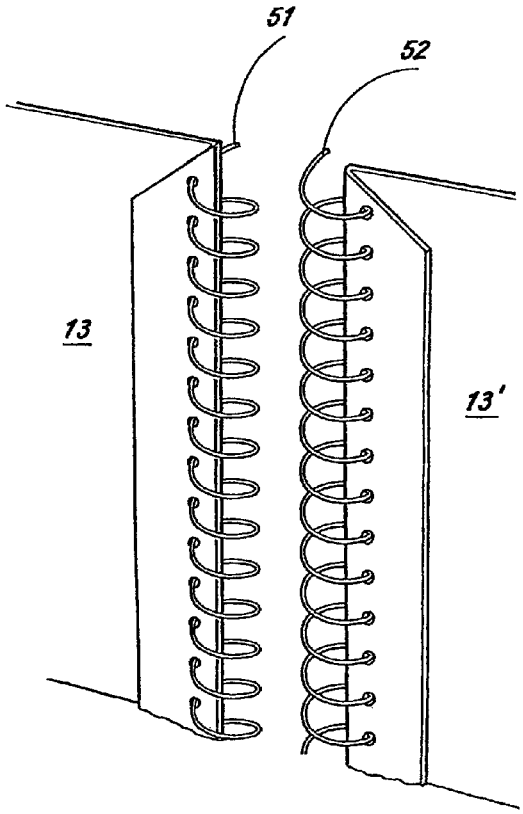
FIG. 5 shows in close-up perspective view the optional openable pivotal connection between neighbouring side wall element panels of the modular gabion of FIG. 1, 2 or 3, before the releasable locking member is installed.
Figure 6:
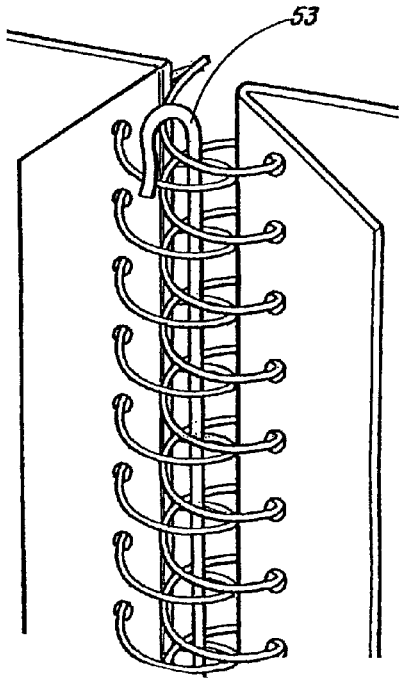
FIG. 6 shows in close-up perspective view the openable pivotal connections were made between the components of the FIG. 5 drawing.

Referring now to FIG. 5, there is shown in close-up perspective view the optional openable pivotal connection between neighbouring side wall elements 13, 13. In this case, both neighbouring closed panels are provided with helical coil members threaded helically through the interconnection edge apertures thereof. The first hinge member 51 and the second hinge member 52 are thereby provided. Releasable locking member 53 is shown in FIG. 6 connecting the overlapped helical coils. Referring now to FIGS. 10 to 15, cross-sections through the gabion are shown where the walls 126 are manufactured of sheet metal. As can be seen, a helical spring 112 is threaded through apertures 114 in the side wall 126.

In FIG. 10, a single fold 130 is provided to reinforce the edge of the wall 126. The aperture 114 passes through both thicknesses 132 of the fold 130.

In FIG. 11, a double fold 134 is provided and the aperture 114 passes through all three thicknesses 136 of the fold 134.

In FIG. 12, a single fold 130 is provided, but the aperture 114 only passes through a single thickness 132.

In FIG. 13, a double fold 134 is provided, but the aperture 114 only passes through a single thickness 136.

In FIGS. 14 and 15, a reinforcing strip 138 is stuck to the wall 126 using a layer of adhesive 140. The aperture can either pass through the reinforcing strip 138, or the wall 126, respectively.

In FIGS. 16, 17 and 18, the aperture only passes through the wall 126. Strength/reinforcement advantages can nonetheless be attained so long as the spring 112 is pulled in the direction indicated by arrow A. This arrangement has the further advantage that the aperture 114 need only be drilled or punched through one thickness of material, which reduces manufacturing costs and/or complexity.

FIGS. 16 to 19 show partial cross-sections of the gabion where the wall 126 is manufactured of a plastics material. As can be seen, a thicker, reinforced region 142 is relatively easily formed using a suitable moulding technique. In FIGS. 17 to 19, a reinforcing wire 144 has been co-moulded with the wall 126 to further reinforce the edge thereof.

A further possible variant of the invention sees reinforcing wires or a reinforcing mesh 146 being integrally mounded with the wall 126 as illustrated in FIG. 17. This feature means that much thinner wall thicknesses can be provided for a given strength requirement.

Figure 20:
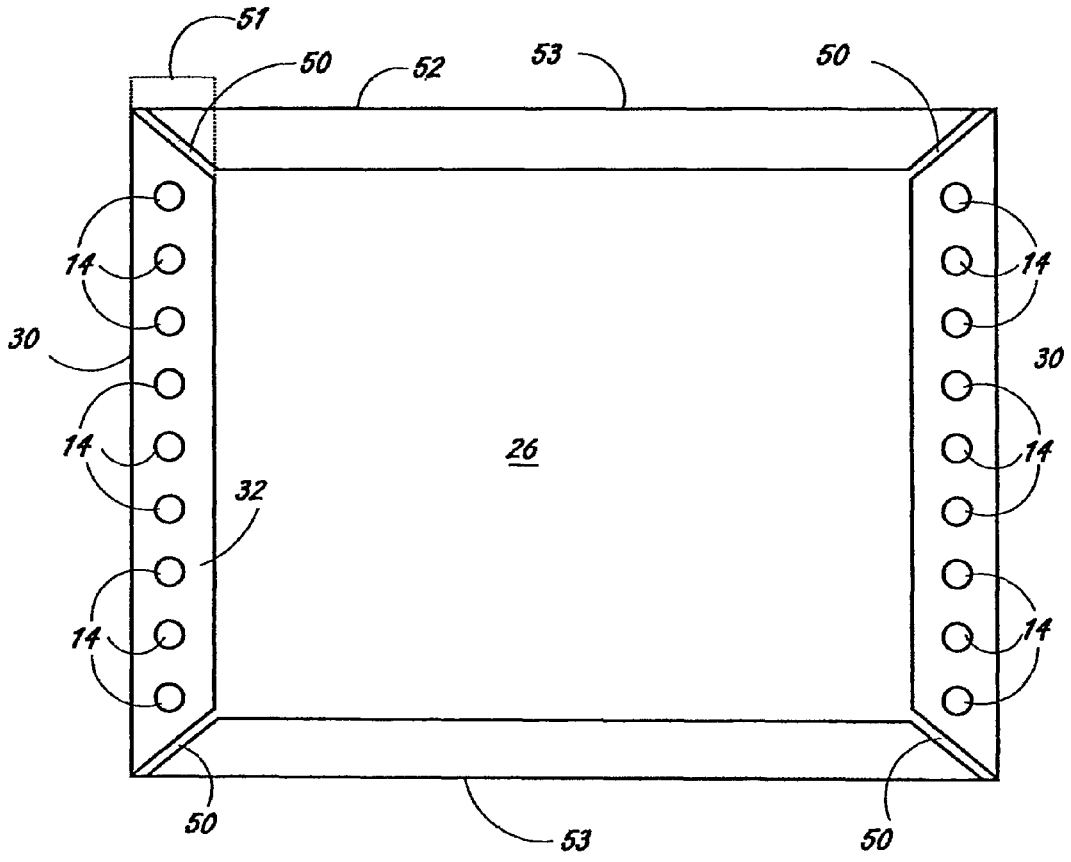
FIG. 20 shows a side view of a wall of the single box gabion.

FIG. 20 shows a side view of a wall panel 126 having an edge reinforcement as illustrated in FIG. 6. As can be seen, the corners of the fold 130 have been cut away 150 to prevent sharp edges 151 (indicated by a dotted line) protruding above the edge 152 of the wall 126.

As can also be seen in FIG. 16, the top and bottom edges 153 of the wall 126 have also been folded over to facilitate manual handling of the gabion and to prevent damage to neighbouring objects (not shown) such as a floor surface.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention, which is defined by the following embodiments. The embodiments are intended to cover the claimed components and steps in any sequence which is effective to meet the objectives there intended, unless the context specifically indicates the contrary.

What is claimed is:

1. A gabion comprising a plurality of interconnected side walls, each side wall comprising at least one substantially closed side wall element panel, wherein each substantially closed side wall element panel is manufactured of a rigid sheet material, wherein the substantially closed side wall element panel is provided with hinge receiving means for receiving a hinge member for the purpose of connecting the substantially closed side wall element panel pivotally to a neighbouring side wall element panel, thus allowing the gabion to fold for storage or transport, wherein said gabion can be folded without detaching the panels from one another and can be unfolded to bring the gabion to an erected condition without the requirement for any further connection of the side walls, wherein said substantially closed side wall element panel is effective in preventing a gabion fill material from falling through the side wall without the aid of a gabion lining material, further wherein said pivotally connected side wall element panels, when erected, define side walls around a central compartment and an open top through which the compartment can be filled.

2. The gabion according to claim 1, wherein said gabion fill material is sand.

3. The gabion according to claim 1, wherein the rigid sheet material has a rigidity that is sufficient to prevent bulging of the side wall element panel when the gabion is filled with a fill material.

4. The gabion according to claim 1, wherein the hinge receiving means are provided on a region of the closed panel of greater thickness than an adjacent region of the panel.

5. The gabion according to claim 4, wherein the relatively greater thickness of the hinge receiving means section of the panel helps to prevent tearing of the panel by the hinge member in use of the gabion when the side walls of the gabion act to restrain the gabion fill material.

6. The gabion according to claim 4, wherein the region of the closed panel of relatively greater thickness is provided at or in the region of an interconnection edge of the closed panel.

7. The gabion according to claim 6, wherein the region of relatively greater thickness is an elongate panel region alongside or at the interconnection edge.

8. The gabion according to claim 7, wherein the elongate panel section of relatively greater thickness is provided by a folded over edge section of the substantially closed panel.

9. The gabion according to claim 8, wherein the corners of the panel at either or both ends of the edge being folded are removable so that they can be removed prior to folding in order to facilitate the folding over of the panel.

10. The gabion according to claim 1, further comprising a top panel that functions as a lid of the gabion.

11. The gabion according to claim 10, wherein the top panel is a substantially closed panel.

12. The gabion according to claim 1, wherein the hinge receiving means comprises one or more apertures in the panel and means for covering or blocking the one or more apertures to prevent or hinder a gabion fill material from escaping through said one or more apertures.

13. The gabion according to claim 1, further comprising coupling means to couple to another gabion.

14. The gabion according to claim 1, wherein the pivotal connection between neighbouring side wall element panels is achieved by providing a coil member helically threaded through a plurality of apertures along the interconnecting edges of the neighbouring side wall element panels.

15. The gabion according to claim 1, wherein each substantially closed panel having releasable interconnections which when released allow the side wall element panels to open with respect to the gabion to allow access from the side of the gabion to any contents of the gabion compartments.

16. The gabion of claim 1, wherein said gabion is a multi-compartmental gabion.

17. A modular gabion structure, comprising a plurality of gabions of claim 1.

18. A method for deploying the foldable gabion according to claim 1, comprising transporting a folded gabion to a deployment site, unfolding the gabion and filling the gabion with a fill material.

19. The method according to claim 18, wherein the fill material is selected from the group consisting of sand, earth, soil, stones, rocks, rubble, concrete, debris, snow, ice and combinations of two or more thereof.

20. The method of claim 18, further comprising coupling the unfolded gabion to another unfolded gabion.

21. A gabion comprising a plurality of interconnected side walls, each side wall comprising at least one substantially closed side wall element panel, wherein each substantially closed side wall element panel is manufactured of a rigid sheet material, wherein the substantially closed side wall element panel is provided with hinge receiving means for receiving a hinge member for the purpose of connecting the substantially closed side wall element panel pivotally to a neighbouring side wall element panel, thus allowing the gabion to fold for storage or transport, wherein said gabion can be folded without detaching the panels from one another, wherein said substantially closed side wall element panel is effective in preventing a gabion fill material from falling through the side wall without the aid of a gabion lining material, wherein the hinge receiving means are provided on a region of the closed panel of greater thickness than an adjacent region of the panel.

22. A gabion comprising a plurality of interconnected side walls, each side wall comprising at least one substantially closed side wall element panel, wherein each substantially closed side wall element panel is manufactured of a rigid sheet material, wherein the substantially closed side wall element panel is provided with hinge receiving means for receiving a hinge member for the purpose of connecting the substantially closed side wall element panel pivotally to a neighbouring side wall element panel, thus allowing the gabion to fold for storage or transport, wherein said gabion can be folded without detaching the panels from one another, wherein said substantially closed side wall element panel is effective in preventing a gabion fill material from falling through the side wall without the aid of a gabion lining material, wherein the hinge receiving means comprises one or more apertures in the panel and means for covering or blocking the one or more apertures to prevent or hinder a gabion fill material from escaping through said one or more apertures.

23. A gabion comprising a plurality of interconnected side walls, each side wall comprising at least one substantially closed side wall element panel, wherein each substantially closed side wall element panel is manufactured of a rigid sheet material, wherein the substantially closed side wall element panel is provided with hinge receiving means for receiving a hinge member for the purpose of connecting the substantially closed side wall element panel pivotally to a neighbouring side wall element panel, thus allowing the gabion to fold for storage or transport, wherein said gabion can be folded without detaching the panels from one another, wherein said substantially closed side wall element panel is effective in preventing a gabion fill material from falling through the side wall without the aid of a gabion lining material, wherein the pivotal connection between neighbouring side wall element panels is achieved by providing a coil member helically threaded through a plurality of apertures along the interconnecting edges of the neighbouring side wall element panels.

* * * * *